US007757861B2

(12) United States Patent
Wang et al.

(10) Patent No.: US 7,757,861 B2
(45) Date of Patent: Jul. 20, 2010

(54) PACKAGE ASSEMBLY WITH CROSS-SHAPED RETAINING MEMBER

(75) Inventors: Guan-Dong Wang, Shenzhen (CN); Xiang-Yu You, Shenzhen (CN); Gang Peng, Shenzhen (CN); Hsiang-Lung Hsu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 3 days.

(21) Appl. No.: 12/238,027

(22) Filed: Sep. 25, 2008

(65) Prior Publication Data

US 2010/0012549 A1 Jan. 21, 2010

(30) Foreign Application Priority Data

Jul. 16, 2008 (CN) ..... 2008 2 0301529

(51) Int. Cl.
*B65D 81/02* (2006.01)
*B65D 85/30* (2006.01)

(52) U.S. Cl. ..... 206/591; 206/480; 206/521; 206/523

(58) Field of Classification Search ..... 206/477–480, 206/521, 523, 591–592, 586, 588
See application file for complete search history.

(56) References Cited

U.S. PATENT DOCUMENTS

| | | | | | |
|---|---|---|---|---|---|
| 3,596,754 | A * | 8/1971 | Peterson, Jr. | ..... | 206/523 |
| 4,201,293 | A * | 5/1980 | Rigazio et al. | ..... | 206/523 |
| 4,899,876 | A * | 2/1990 | Murphy et al. | ..... | 206/591 |
| 5,184,727 | A * | 2/1993 | Dickie et al. | ..... | 206/591 |
| 5,207,327 | A * | 5/1993 | Brondos | ..... | 206/523 |
| 5,353,921 | A * | 10/1994 | Tyra | ..... | 206/523 |
| 5,738,216 | A * | 4/1998 | Warner | ..... | 206/523 |
| 6,082,543 | A * | 7/2000 | Beliveau | ..... | 206/523 |
| 6,092,651 | A * | 7/2000 | Miller | ..... | 206/521 |
| 6,241,090 | B1 * | 6/2001 | Kaplinsky | ..... | 206/523 |
| 6,499,599 | B1 * | 12/2002 | Hopkins et al. | ..... | 206/523 |

* cited by examiner

*Primary Examiner*—Bryon P Gehman
(74) *Attorney, Agent, or Firm*—Clifford O. Chi

(57) ABSTRACT

A package assembly for a product includes a cushion pad and a retaining member engaged with the cushion pad for retaining the product on the cushion pad. The retaining member defines a plurality of expandable cuts therein so as to increase the elastic extendibility of the retaining member.

14 Claims, 3 Drawing Sheets

PACKAGE ASSEMBLY WITH CROSS-SHAPED RETAINING MEMBER

BACKGROUND

1. Technical Field

The present invention relates to a package assembly suitable for products of various sizes.

2. Description of Related Art

A typical package assembly includes a paper box and a cushion pad. A recess is defined in the cushion pad for accommodating a product and protecting the product from a sudden shock that may occur during distribution. In order to conform to environmental recycling regulations, the cushion pad utilizes elastic cushion materials such as expanded polythene (EPE). However, the package assembly can only accommodate a product having one size. The package must be redesigned if it is to be used for a different sized product.

Therefore, a package assembly able to accommodate products of various sizes is desired to overcome the above-described deficiencies.

DETAILED DESCRIPTION OF THE EMBODIMENTS

Figure 1:
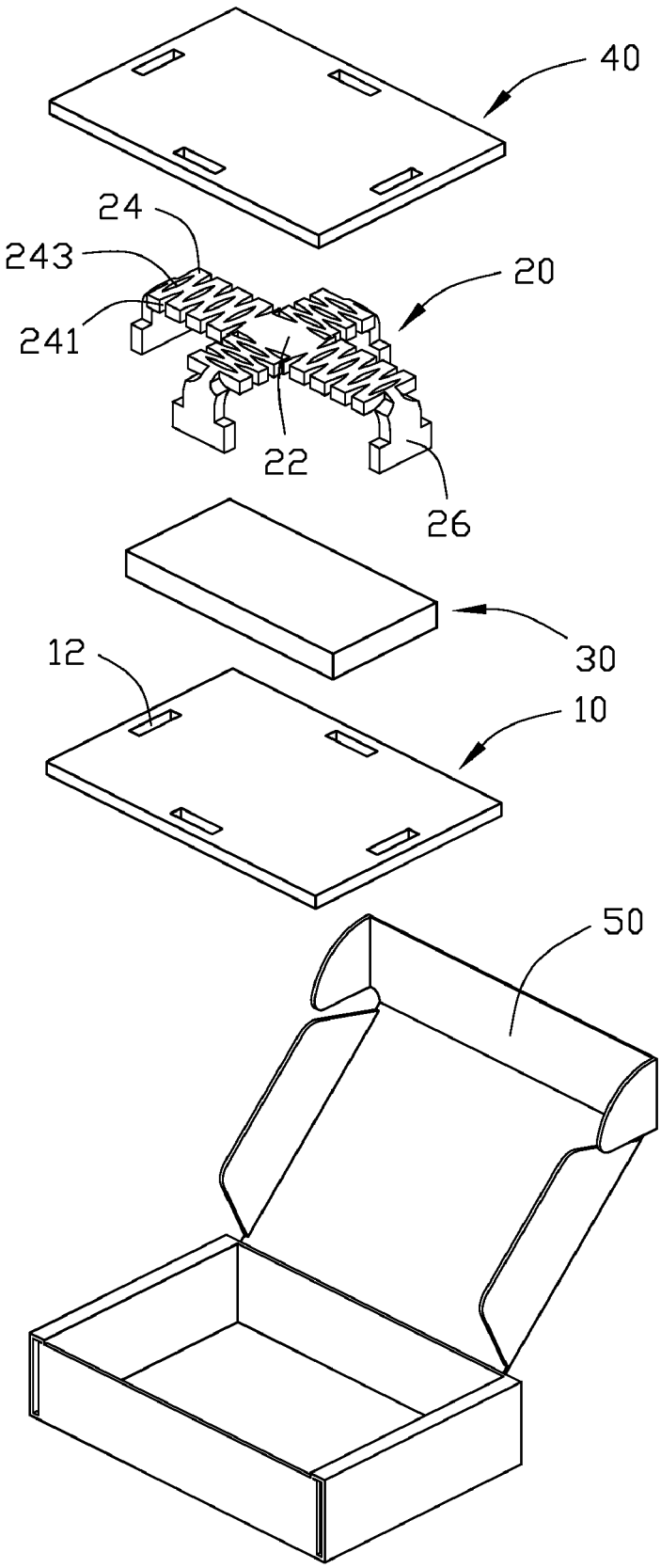
FIG. 1 is an embodiment of a package assembly for protecting a product, the package assembly including a box, a first cushion pad, a second cushion pad, and an elastic retaining member.

Referring to FIG. 1, an embodiment of a package assembly includes a first cushion pad 10, an elastic retaining member 20, a second cushion pad 40, and a box 50. The package assembly is used for accommodating a product 30 therein and protecting the product 30 from sudden shocks during transport. The first cushion pad 10, the retaining member 20, and the second cushion pad 40 may be made from an expanded polythene (EPE) material to conform to environmental regulations.

The first cushion pad 10 is generally rectangular-shaped. A notch 12 is defined near each side of the first cushion pad 10. The first cushion pad 10 is wider than the product 30 for supporting the product 30 thereon.

The elastic retaining member 20 is cross-shaped and includes a central area 22 and two pairs of resilient arms 24 extending from the central area 22. One pair of symmetrical resilient arms 24 is extendable along a first direction, and another pair of symmetrical resilient arms 24 is extendable along a second direction perpendicular to the first direction. Each of the resilient arms 24 defines a plurality of symmetrical first cuts 241 at opposite side edges thereof, and a plurality of equidistant second cuts 243 defined in an inner portion thereof. Between every two adjacent second cuts 243, there is a corresponding one of the symmetrical first cuts 241. When the resilient arms 24 are extended, the first cuts 241 and the second cuts 243 expand, thus allowing increased elastic extendibility of the resilient arms 24. Each of the resilient arms 24 has a retaining block 26 corresponding to the notches 12 of the first cushion pad 10. Each retaining block 26 includes a neck section and a block section wider than the neck section. A width of the neck section is approximately equal to that of the corresponding notch 12, and a width of the block section is greater than that of the corresponding notch 12.

Figure 2:
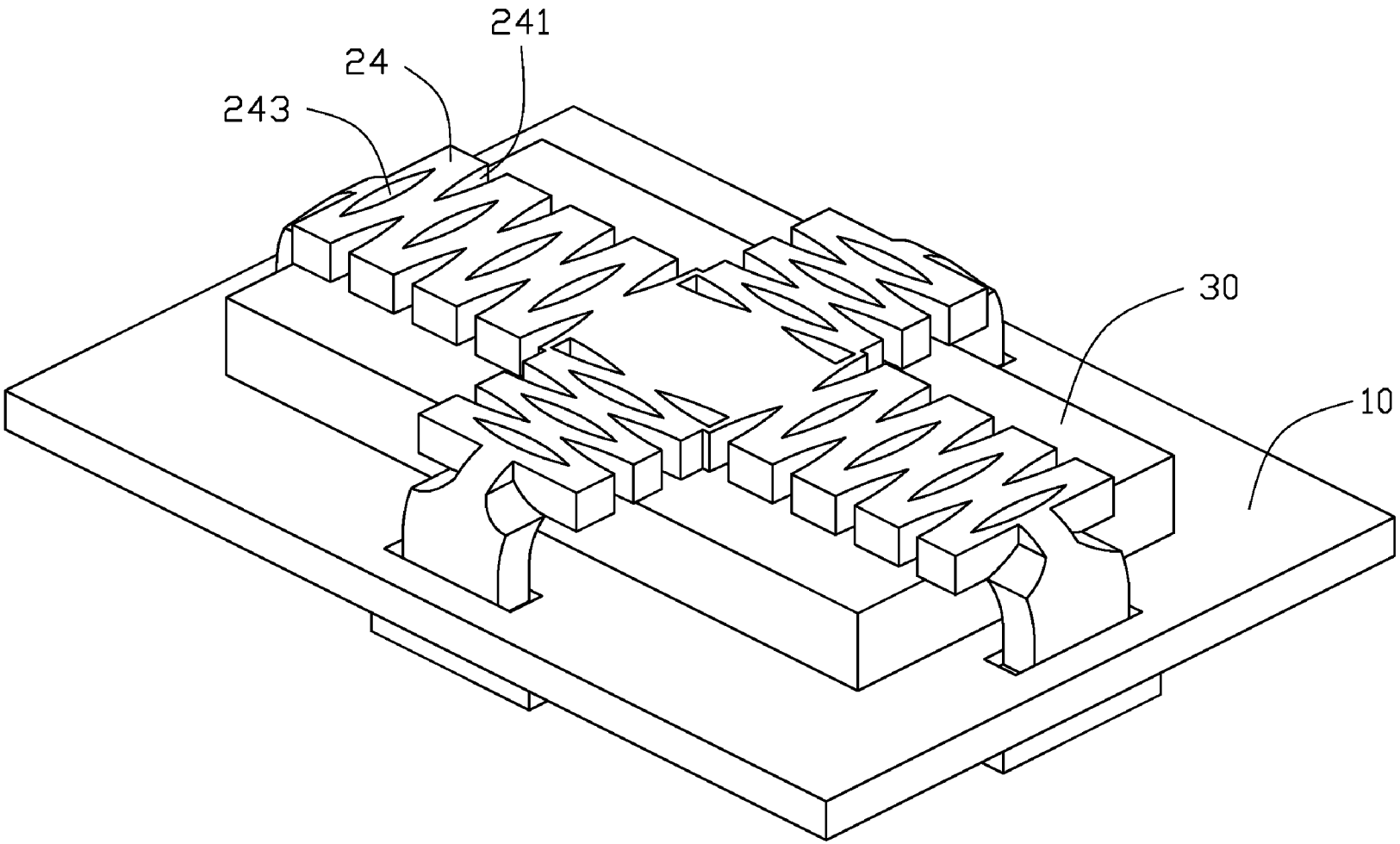
FIG. 2 is a partial assembled view of FIG. 1, showing the product attached between the elastic retaining member and the first cushion pad.
Figure 3:
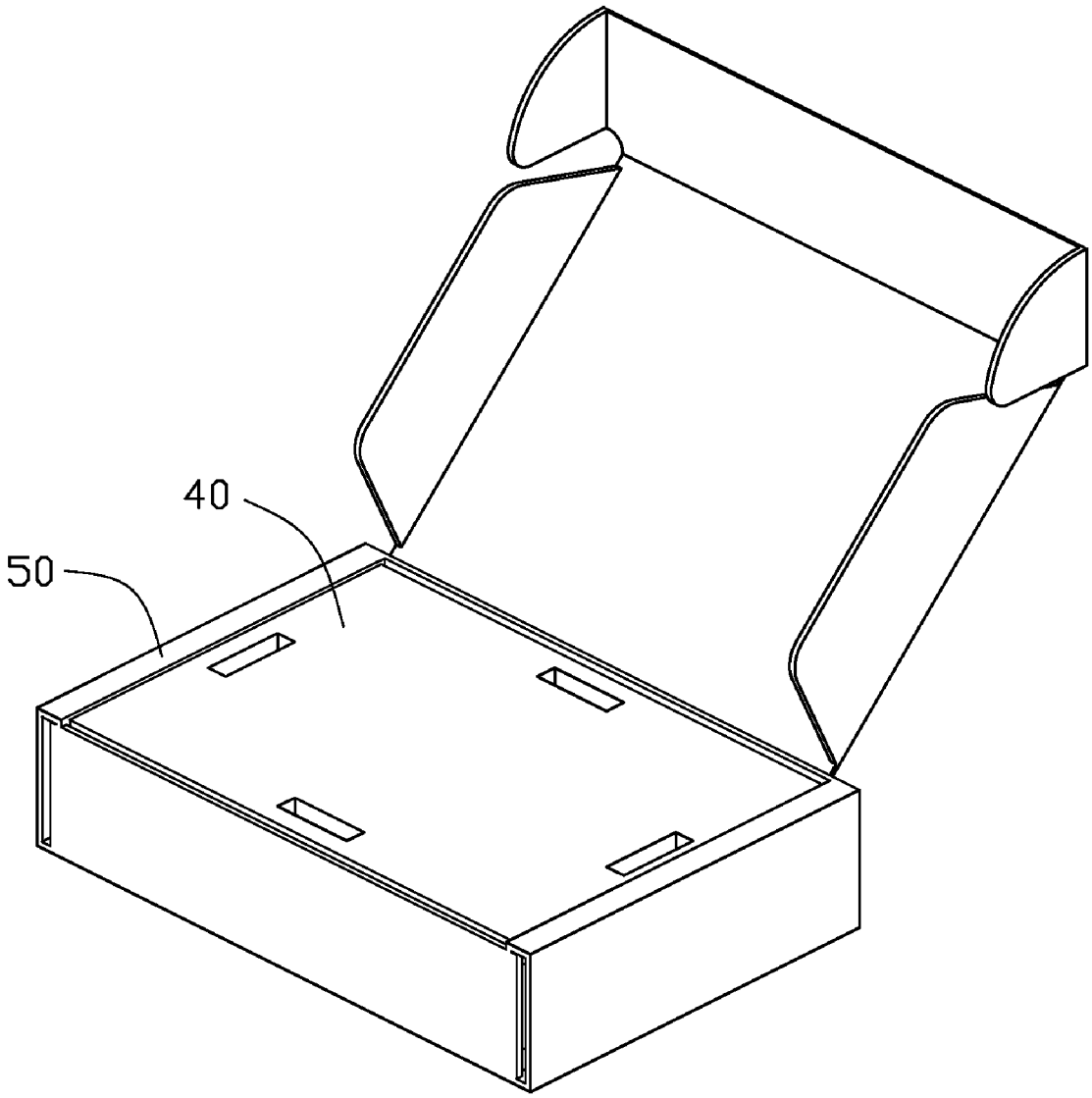
FIG. 3 is an assembled view of FIG. 1.

Referring to FIGS. 2 and 3, in assembly, the product 30 is positioned on the first cushion pad 10. The neck sections of the retaining blocks 26 of the elastic retaining member 20 are engaged in the notches 12 of the first cushion pad 10, and the block sections of the retaining blocks 26 are resisted against a bottom surface of the first cushion pad 10. The product 30 is retained on the first cushion pad 10 by the elastic retaining member 20. The product 30 together with the first cushion pad 10 and the elastic retaining member 20 is accommodated in the box 50. The second cushion pad 40 is positioned to cover the elastic retaining member 20. Then a cover of the box 50 can be rotated shut.

In above described embodiment, the retaining member 20 defines a plurality of cuts therein, thereby increasing extendibility of the resilient arms 24 to accommodate a variety of different sized products.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A package assembly for a product, comprising:

a cushion pad with notches defined therein; and a cross-shaped retaining member with four distal ends engaged with the notches of the cushion pad for retaining the product on the cushion pad, the retaining member defining a plurality of expandable cuts therein to increase elastic extendibility of the retaining member.

2. The package assembly of claim 1, wherein the retaining member is extendable along a first direction, the cuts are defined perpendicular to the first direction and expandable along the first direction.

3. The package assembly of claim 1, wherein the retaining member comprises a central area, a first pair of resilient arms that extend from one pair of opposite sides of the central area along a first direction, and a second pair of resilient arms extending from another pair of opposite sides of the central area along a second direction perpendicular to the first direction.

4. The package assembly of claim 3, wherein each of the resilient arms defines a plurality of first cuts in an inner portion and a plurality of second cuts at opposite sides of each of the resilient arms.

5. The package assembly of claim 4, wherein the first cuts are equidistantly defined in each of the resilient arms, and the second cuts are symmetrically defined at opposite sides of each of the resilient arms.

6. The package assembly of claim 5, wherein each of the first cuts is defined between a corresponding two adjacent pairs of symmetrical second cuts.

7. The package assembly of claim 3, wherein each of the distal ends of the retaining member has a neck portion engaging a corresponding notch and a block portion that is wider than the neck portion.

8. The package assembly of claim 1, wherein the cushion pad and the retaining member are made from an expanded polythene material.

9. A package assembly for protecting a product, comprising:

a cushion pad;

a cross-shaped retaining member engaged with the cushion pad for retaining the product on the cushion pad, the retaining member defining a plurality of first cuts resiliently expandable along a first direction to increase elastic extendibility thereof along the first direction, and a plurality of second cuts resiliently expandable along a second direction perpendicular to the first direction, to increase elastic extendibility thereof along the second direction;

wherein the retaining member comprises a central area, a first pair of resilient arms extending from one pair of opposite sides of the central area, and a second pair of resilient arms extending from another pair of opposite sides of the central area.

10. The package assembly of claim 9, wherein the first cuts are defined in the first pair of resilient arms and perpendicularly to the first direction, the second cuts are defined in the second pair of resilient arms and perpendicularly to the second direction.

11. The package assembly of claim 10, wherein the first cuts are defined in inner portions of the first pair of resilient arms, and the second cuts are defined in inner portions of the second pair of resilient arms.

12. The package assembly of claim 10, wherein the first cuts are defined at opposite side edges of the first pair of resilient arms, and the second cuts are defined at opposite side edges of the second pair of resilient arms.

13. The package assembly of claim 9, wherein a plurality of notches are defined in the cushion pad, each of the resilient arms comprises a retaining end engaging with a corresponding one of the notches, and each of the retaining ends comprises a neck portion and a block portion that is wider than the neck portion.

14. The package assembly of claim 9, wherein the cushion pad and the retaining member are made from an expanded polythene material.

* * * * *